US007563070B2

(12) United States Patent
Lin et al.

(10) Patent No.: US 7,563,070 B2
(45) Date of Patent: Jul. 21, 2009

(54) COOLING FAN

(75) Inventors: Yu-Chen Lin, Guangdong (CN); Hong-Bo Xu, Guangdong (CN)

(73) Assignees: Hong Fu Jin Precision Industry (Shen Zhen) Co., Ltd., Shenzhen (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 705 days.

(21) Appl. No.: 11/163,678

(22) Filed: Oct. 27, 2005

(65) Prior Publication Data

US 2007/0096570 A1 May 3, 2007

(51) Int. Cl.
*F04D 29/00* (2006.01)

(52) U.S. Cl. ..... 415/118; 415/176; 415/177; 416/5; 417/63; 310/73; 362/96; 362/234; 362/545; 362/646; 362/800

(58) Field of Classification Search ..... 415/118, 415/175–178; 416/5, 61; 40/431, 433, 442, 40/444; 310/73; 417/63; 362/96, 234, 545, 362/646, 800; 257/97
See application file for complete search history.

(56) References Cited

U.S. PATENT DOCUMENTS 4,949,022 A 8/1990 Lipman
6,679,711 B2 1/2004 Takahashi
6,790,003 B1 * 9/2004 Hu et al. ..... 416/5
7,121,697 B2 * 10/2006 Hsu ..... 416/5
7,160,080 B2 * 1/2007 Lin ..... 415/177
7,300,173 B2 * 11/2007 Catalano et al. ..... 362/646
7,332,841 B2 * 2/2008 Hsu ..... 310/73

FOREIGN PATENT DOCUMENTS

CN 2639583 Y 9/2004
CN 2641353 Y 9/2004

* cited by examiner

*Primary Examiner*—Christopher Verdier
(74) *Attorney, Agent, or Firm*—Winston Hsu

(57) ABSTRACT

A cooling fan (100) includes a frame (10), a circuit board (20) and a rotor (30). The frame includes a housing (12) and a plate (14) connecting with the housing. The circuit board is mounted on the plate. The rotor is received in the housing and includes a hollow hub (32) and a plurality of blades (38) extending from the hub. A plurality of light emitting diodes (40) is mounted on the circuit board. When the rotor rotates, each LED projects light towards the rotor and to the frame so that the light will be reflected and deflected by the fan whereby the whole fan glows and produces a fantastic visual effect.

16 Claims, 3 Drawing Sheets

COOLING FAN

FIELD OF THE INVENTION

The present invention relates generally to a cooling fan, and particularly to a cooling fan for cooling a heat-generating element such as a CPU by the use of a heat sink to which a frame of the fan is attached.

DESCRIPTION OF RELATED ART

A computer central processing unit (CPU) is the core administrator of electrical signals in the contemporary personal computer. Continued development of the CPUs has enabled them to perform more and more functions. Heat generated by the CPUs has increased enormously. Such heat can adversely affect the operational stability of the computers. Measures must be taken to efficiently remove the heat from the CPU. Typically, a heat sink having great heat conductivity is mounted on the CPU to remove heat therefrom. A fan is often attached to the heat sink to provide forced air convection thereto.

A conventional computer generally has an opaque computer enclosure and the fan is enclosed by the opaque computer enclosure. The fan is invisible from outside of the enclosure. The utility requirement of the computer is the major factor for a designer in designing the conventional computer.

Nowadays, however, a computer having not only a great utility but also an attractive appearance will definitely attract more users to use it. The computer having a transparent side panel is more and more popular. Bright light emits out from a light source in the computer enclosure through the transparent side panel. A fan in the computer may be visible and it can be a vital part to the appearance of the computer. To make the fan emit light and visible, an LED (Light-Emitting Diode) is mounted on the fan. The LED is small and inexpensive, so more and more LED modules with different functions are being developed.

Chinese Patent Publication No. 2641353Y discloses a fan having a frame. A rotor is received in the frame. A plurality of holes is defined in an external periphery of the frame. An LED is mounted in each hole and projects light. However, firstly, the process to finish the holes is unduly time-consuming. Simultaneously the formation of the holes in the frame complicates the mold for forming the fan frame. Secondly, the LED emits light outwardly from the external periphery of the frame such that the light does not project on the rotor.

Another conventional fan having LEDs is disclosed by U.S. Pat. No. 6,679,771B2. The fan comprises a housing having a circular inner side. Multiple LED holes are defined in the inner side of the housing. Each LED is mounted in each hole. The LEDs project light toward a rotor in the housing. This type of the fan may have a large amount of light projected on the rotor, but there is a little light projected on an external periphery of the housing due to the location of the LEDs.

SUMMARY OF INVENTION

Accordingly, what is needed is a cooling fan having light emitting diodes which project light towards the whole fan.

According to a preferred embodiment of the present invention, a cooling fan comprises a frame, a circuit board and a rotor. The frame comprises a housing and a plate connecting with the housing. The housing is transparent and coated with a picture consisting of fluorescent material. A central tube extends from a center of the plate. The circuit board defines a central hole for permitting passage of the tube. The rotor includes a hollow hub and a plurality of blades extending outwardly from the hub. A plurality of spaced ears radially and horizontally extends from an edge of the circuit board. A protrusion is mounted on each ear. The protrusion forms a bevel thereon. A light emitting diode is perpendicularly mounted on the bevel of the protrusion. When the rotor rotates, each LED projects light towards the rotor and to the frame so that the light will be reflected and deflected to the fluorescent picture of the housing of the frame, whereby the whole fan glows and produces a fantastic visual effect.

Other advantages and novel features of the present invention will become more apparent from the following detailed description of the preferred embodiment when taken in conjunction with the accompanying drawings, in which:

DETAILED DESCRIPTION

Figure 1:
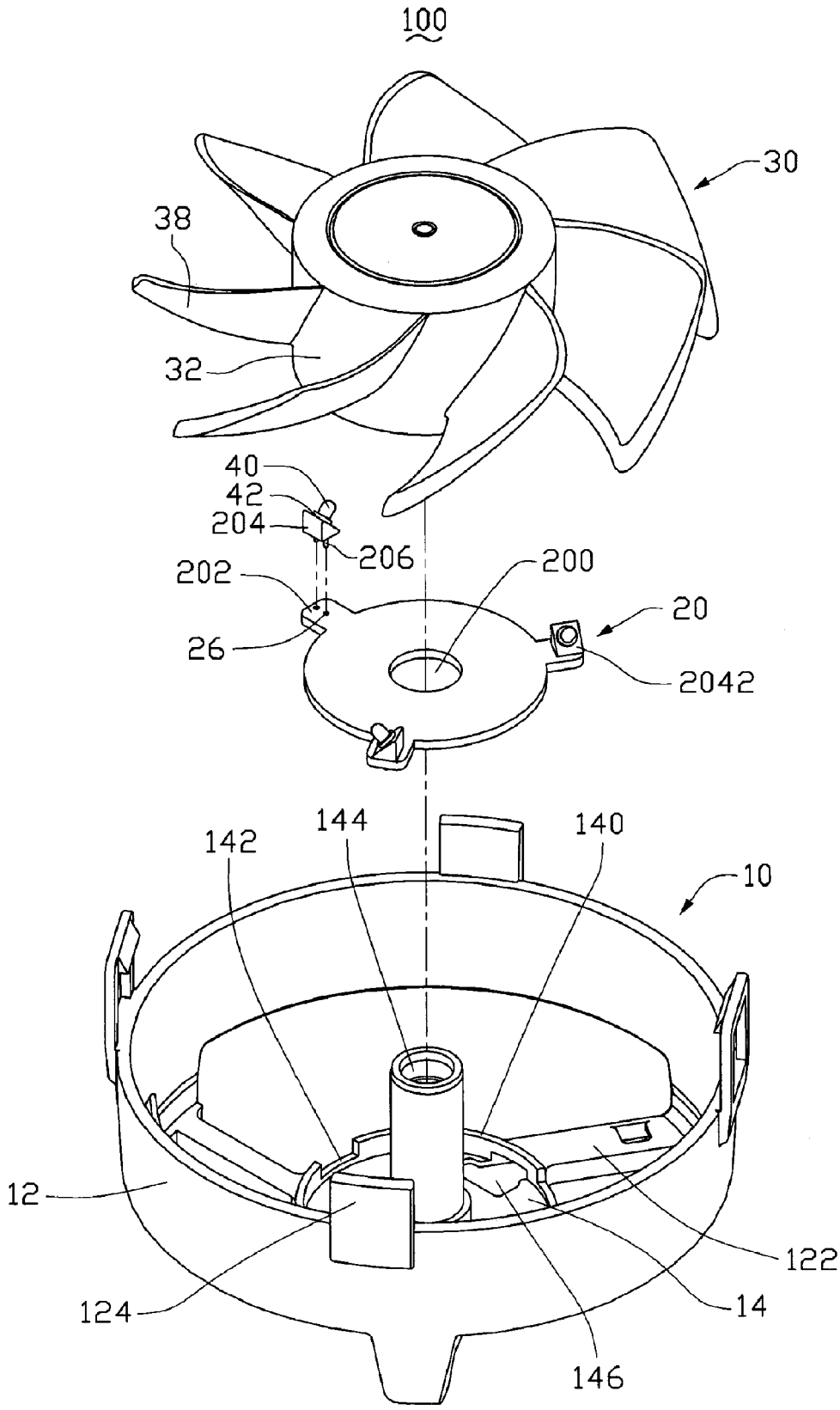
FIG. 1 is an exploded, isometric view of a cooling fan according to a preferred embodiment of the present invention.

Referring to FIG. 1, a cooling fan 100 in accordance with present invention comprises a frame 10, a circuit board 20 and a rotor 30. The frame 10 supports the circuit board 20 and the rotor 30.

Figure 2:
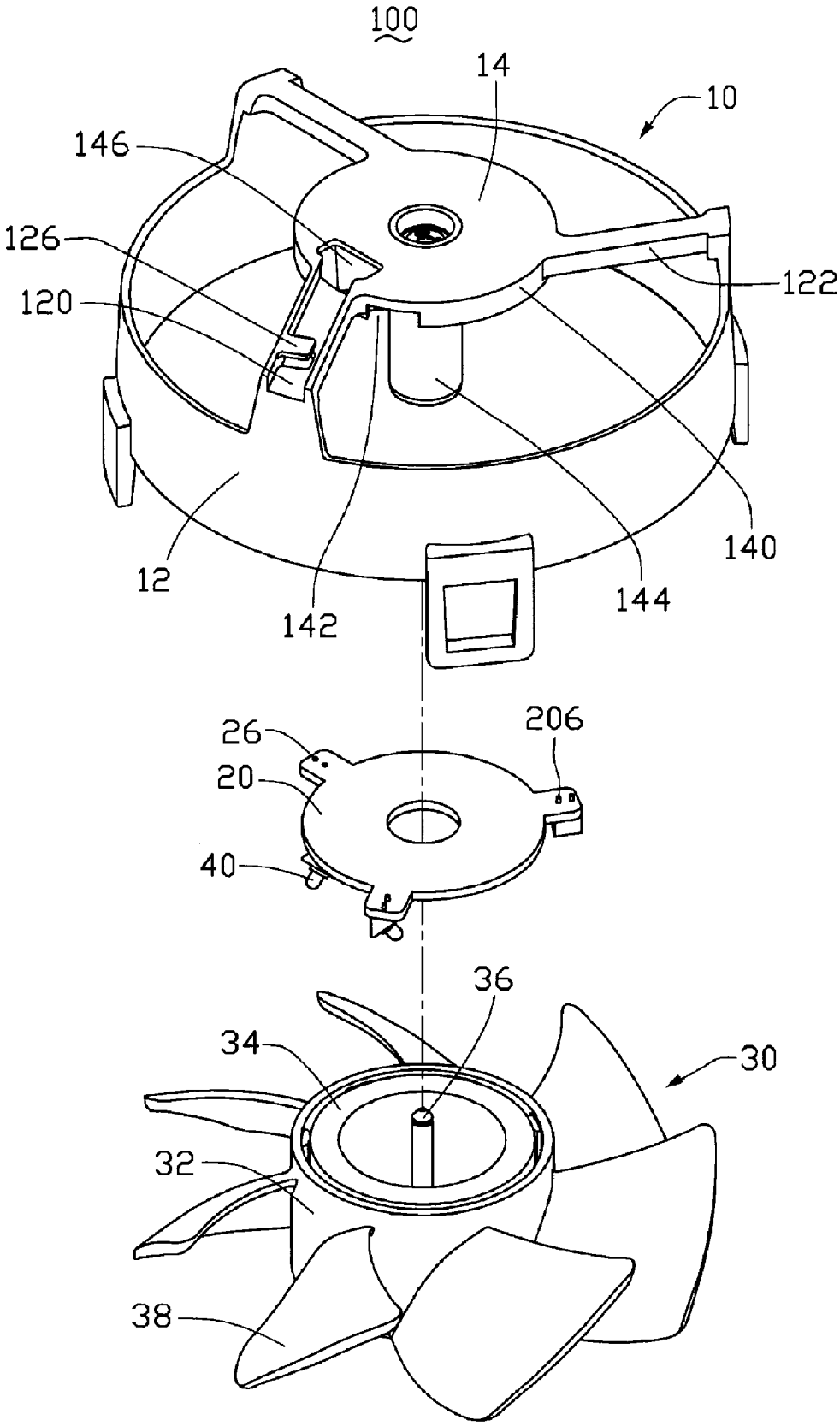
FIG. 2 is similar to FIG. 1, but viewed from a bottom aspect.

Please also referring to FIG. 2, the frame 10 is transparent or translucent. The frame 10 is made of plastic, and comprises a cylindrical housing 12 having opposite top and bottom open ends (not labeled) and a disc-like bottom plate 14. The plate 14 connects with the housing 12 via a plurality of ribs 122 formed at the bottom open end of the housing 12. One of the ribs 122 defines a lead wire retaining recess 120 in a bottom thereof, for retaining lead wires (not shown) of the cooling fan 100. A block 126 is formed at a side edge of the rib 122 having the retaining recess 120, for fixing and protecting the wires. A plurality of lock portions 124 is formed on the housing near 12 the top open end of the housing 12, for providing a detachable connection between the fan 100 and a heat sink (not shown). An outer surface of the housing 12 is coated with a picture (not shown) consisting of fluorescent material, which can absorb and emit light. The bottom plate 14 comprises a cylinder wall 140 defining three spaced cutouts 142, and a central tube 144 extending upwardly from a center of the bottom plate 14 toward the circuit board 20 and the rotor 30. The cylinder wall 140 is formed at a periphery of the bottom plate 14. A notch 146 communicating with the lead wire retaining recess 120 is defined in the plate 14, for providing passage of the lead wires.

The circuit board 20 has a plate-like shape and is circular. A central hole 200 is defined in a center of the circuit board 20, for permitting passage of the tube 144 of the frame 10 through the circuit board 20. A stator (not shown) having multiple coils securely wound around the tube 144 sits on the circuit board 20. Three equally-spaced ears 202 radially and horizontally extend from a circumferential edge of the circuit board 20, corresponding to the cutouts 142, respectively. Each ear 202 defines two positioning holes 26. A protrusion 204 is mounted on each ear 202, whereby in the present invention at least one protrusion 204 is formed on the circuit board 20. The protrusion 204 is triangle and forms a bevel 2042. An LED 40 having a lamp holder 42 is mounted on the bevel 2042, wherein the LED 40 is mounted on the lamp holder 42 and the lamp holder 42 is mounted on the bevel 2042 of the protrusion 204. The LED 40 is oriented perpendicularly to the bevel 2042. Each LED 40 has two terminals 206 which include a positive terminal and a negative terminal. The positive and negative terminals 206 of the LED 40 extend through the protrusion 204 and are electrically connected to the circuit board 20 via a soldering of the terminals 206 in the holes 26 of the circuit board 20.

The rotor 30 comprises a hollow hub 32, a plurality of fan blades 38 radially and outwardly extending from the hub 32, and a shaft 36 extending from a center of the hub 32 for being mounted in the tube 144 of the frame 10. The hub 32 is translucent or transparent, and has an inside perimeter. A plurality of permanent magnets 34 is disposed on the inside perimeter of the hub 32. The rotor 30 sits inside the housing 12 of the frame 10 when the stator is completely surrounded by the permanent magnets 34 inside the hub 32. The rotor 30 is rotated by an interaction between the magnetic forces generated by the coils of the stator and the permanent magnets 34.

Figure 3:
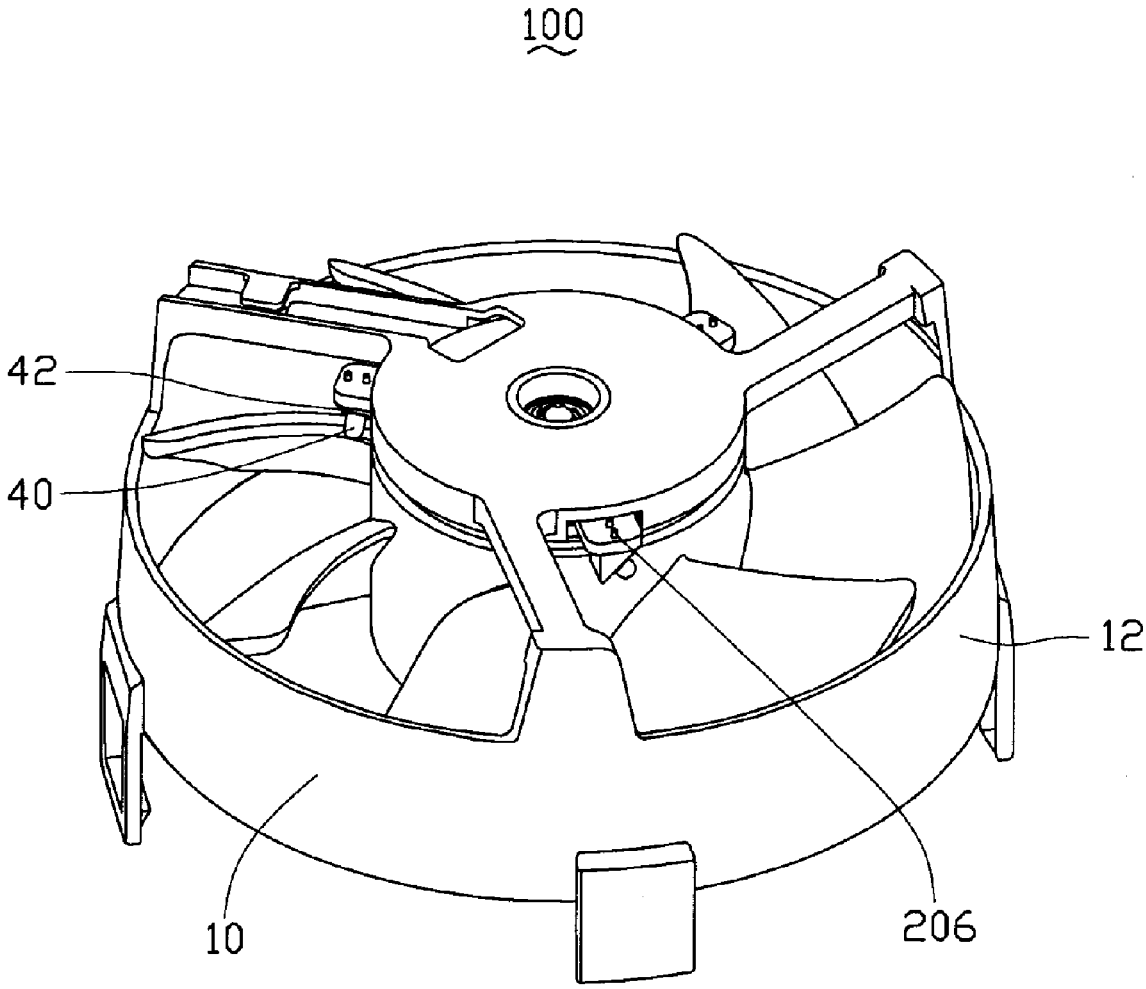
FIG. 3 is an assembled view of FIG. 2.

Please also referring to FIG. 3, in assembly of the cooling fan 100, the LEDs 40 are mounted on the lamp holder 42. The combined LEDs 40 and the lamp holders 42 are perpendicularly positioned onto the bevels 2042 of the protrusions 204, respectively. The terminals 206 extend in the positioning holes 26 of the ears 202 and are soldered to the circuit board 20. The circuit board 20 is mounted on the plate 14 of the frame 10 and sits around the tube 144 of the frame 10 after the tube 144 extends through the central hole 200 of the circuit board 20. Simultaneously, the ears 202 of the circuit board 20 are engaged in the cutouts 142 of plate 14, respectively, such that the LEDs 40 are positioned outside an outer periphery of the cylinder wall 140 of the plate 14. Then, the rotor 30 is brought to sit inside the housing 12 of the frame 10 by extending the shaft 36 in the tube 144 of the frame 10. The hub 32 surrounds the tube 144. The LEDs 40 are positioned outside an outer periphery of the hub 32 of the rotor 30. The circuit board 20 is located between the bottom plate 14 of the frame 10 and the rotor 30.

In use of the cooling fan 100, the cooling fan 100 is positioned on the heat sink mounted on a CPU of a computer. The computer has a transparent side panel. Turn on the power supply, the rotor 30 rotates and generates airflow to dissipate heat generated by the CPU. The LEDs 40 on the circuit board 20 are controlled by the circuit board 20. When the rotor 30 rotates, each LED 40 projects light towards the rotor 30 and to the frame 10 so that the light will be reflected or deflected to the fluorescent picture on the housing 12 of the frame 10 whereby the whole fan 100 glows and produces a fantastic visual effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cooling fan, comprising:

a frame having a housing and a plate connecting with the housing, a central tube extending from a center of the plate;

a circuit board having a central hole, the tube extending through the central hole, the circuit board sitting on the plate, at least one protrusion being formed on the circuit board, the at least one protrusion forming a bevel thereon, and a light emitting diode (LED) being mounted on the bevel and being electrically connected with the circuit board; and a rotor comprising a hub mounted on the tube and a plurality of blades extending outwardly from the hub.

2. The cooling fan as described in claim 1, wherein the LED is positioned outside an outer periphery of the hub of the rotor.

3. The cooling fan as described in claim 1, wherein the circuit board forms a plurality of spaced ears radially and horizontally extending from an edge thereof, the at least one protrusion is mounted on one of the ears.

4. The cooling fan as described in claim 3, wherein the plate comprises a cylinder wall, a plurality of spaced cutouts is defined in the wall corresponding to the ears, and the ears are engaged in the cutouts such that the ears are circumferentially positioned at an outer periphery of the hub of the rotor.

5. The cooling fan as described in claim 1, wherein the LED is mounted on a lamp holder, the combined LED and the lamp holder are perpendicularly positioned onto the bevel of the at least one protrusion.

6. The cooling fan as described in claim 1, wherein the LED has terminals extending through the at least one protrusion toward the circuit board, the terminals extend in the circuit board and are soldered to the circuit board.

7. The cooling fan as described in claim 1, wherein the housing of the frame comprises opposite top and bottom open ends, the bottom open end has a plurality of ribs connecting with the plate of the frame, the top open end forms a plurality of lock portions adapted for providing a detachable connection between the fan and a heat sink.

8. A cooling fan comprising:

a frame;

a circuit board mounted in the frame and having a plurality of light emitting diodes (LEDs) thereon, the LEDs being electrically connected with the circuit board; and a rotor sitting in the frame and comprising a hub and a plurality of blades extending from the hub, wherein the circuit board is located between a bottom of the frame and the rotor;

wherein the circuit board forms a plurality of spaced ears radially and horizontally extending from an edge thereof; and wherein a protrusion with a bevel is formed on each ear, and each of the LEDs has two terminals extending through the bevel of a corresponding protrusion.

9. The cooling fan as described in claim 8, wherein each of the LEDs is mounted on the bevel of the corresponding protrusion.

10. The cooling fan as described in claim 9, wherein each of the LEDs has two terminals extending through the corresponding protrusion toward the circuit board, the terminals extend in the circuit board and are soldered to the circuit board.

11. The cooling fan as described in claim 8, wherein the LEDs are circumferentially positioned outside an outer periphery of the hub of the rotor.

12. The cooling fan as described in claim 8, wherein the frame comprises a housing and a plate connecting with the housing and a tube extending from the plate, the rotor is received in the housing, the rotor has a shaft extending in the tube, the housing is transparent.

13. An electrical fan comprising:

a frame having a plate and a central tube extending from the plate;

a printed circuit board mounted around the central tube of the frame;

a rotor mounted on the tube at a position wherein the printed circuit board is located between the plate of the frame and the rotor, the rotor having a hub, a shaft extending from a center of the hub and extending in the tube, and a plurality of fan blades extending outwardly from the hub; and a plurality of light-emitting devices mounted on the circuit board and located outside the hub of the rotor;

wherein the circuit board has a plurality of protrusions mounted thereon, each protrusion has a bevel and each of the light-emitting devices is mounted on the bevel of a corresponding protrusion.

14. The electrical fan of as described in claim 13, wherein the circuit board is circular with a plurality of ears extending outwardly from an edge of the circuit board, the protrusions are mounted on the ears, respectively.

15. The electrical fan of claim 14, wherein the plate has a cylindrical wall at a periphery of the plate, the cylindrical wall defines a plurality of cutouts therein, the ears engage in the cutouts, respectively.

16. The electrical fan of claim 13, wherein the frame and the rotor are transparent or translucent.

* * * * *